United States Patent [19]
Schwarz
[11] 4,371,006
[45] Feb. 1, 1983

[54] READING AND CONTROL DEVICE FOR A CONTROL MACHINE

[75] Inventor: Rudolf Schwarz, Horgen-Zuerich, Switzerland

[73] Assignee: Staeubli Ltd., Horgen-Zuerich, Switzerland

[21] Appl. No.: 236,824

[22] Filed: Feb. 19, 1981

[30] Foreign Application Priority Data

Feb. 22, 1980 [CH] Switzerland ..... 1417/80

[51] Int. Cl.³ ..... D03C 1/00
[52] U.S. Cl. ..... 139/68; 139/331
[58] Field of Search ..... 139/59, 68, 331; 66/50 R, 75

[56] References Cited

U.S. PATENT DOCUMENTS 748,028 12/1903 Szezepanik ..... 139/331
3,665,972 5/1972 Hoenig ..... 139/331
4,154,268 5/1979 Schwarz ..... 139/68

FOREIGN PATENT DOCUMENTS 1217399 12/1970 United Kingdom ..... 139/68

*Primary Examiner*—Henry Jaudon
*Attorney, Agent, or Firm*—Blanchard, Flynn, Thiel, Boutell & Tanis

[57] ABSTRACT

A reading needle is slidingly supported in a force amplifying bar which is automatically moved up and down and the reading needle reads nonperforated and perforated points of a pattern card. In the case of a perforated point, a pivotal lock member biassed by a spring remains in a first position and pushes a draw arm of a correcting element downwardly unless this draw arm is already in a downward position. When the reading needle reads a nonperforated point, it is moved within the force amplifying bar by the pattern card during forward movement of the force amplifying bar. A sloped surface of a slot in the lock member slides over the head of the reading needle and swings the two-arm lock member to a second position in which one lock member arm reaches within the active range of an offset portion of a second draw arm and tilts the correcting element, whereby a cam surface of a draw hook is supported on an arm of the correcting element. This apparatus is particularly suited for control of shed-forming machines of the Hattersley system.

4 Claims, 3 Drawing Figures

READING AND CONTROL DEVICE FOR A CONTROL MACHINE

CROSS-REFERENCE TO RELATED APPLICATION

This application is related to a co-pending application entitled "READING AND LIFTING DEVICE FOR A CONTROL MACHINE", Ser. No. 236,482, filed Feb. 23, 1981.

FIELD OF THE INVENTION

This invention relates to a reading and control device for a control machine which can be controlled by a pattern card having nonperforated and perforated points or locations thereon.

BACKGROUND OF THE INVENTION

A control machine of the foregoing type typically has a reading needle for reading the pattern card and a force amplifying bar which acts in the direction of movement of the reading needle onto a control part, the reading needle being movably supported in the force amplifying bar to project against the pattern card and being in active connection with a lock member which is pivotally supported on the force amplifying bar for movement between two positions, a portion of the lock member in each such position being in the path of movement of control parts of the control device.

Such devices have become known and are disclosed, for example, in my U.S. Pat. No. 4,154,268. Various embodiments described therein are now being utilized in practice, depending on the purpose of use of a machine. All, however, work according to the same system, in which the position of a reading needle for a pattern card, which reading needle is operated with a small force, is utilized to apply a control movement onto a heavier machine part through a part which is driven with a greater force.

The purpose of the invention is to provide a reading needle having a higher force relief with a higher assurance of an effective control operation.

SUMMARY OF THE INVENTION

This purpose is achieved by providing a device of the above-mentioned type in which the lock member is a two-arm lever having the arms extending approximately parallel to one another and forming a slot in which the head of the reading needle is received, the inner surface of one arm being sloped near its front end to form a sliding surface for the head of the reading needle, in which a pressure spring arranged between the lock member and the force amplifying bar presses the sloped sliding surface of the one arm against the head of the reading needle, and in which the two ends of the lock member each reaches beyond the force amplifying bar during its extreme outermost swing and reaches into the path of movement of an offset portion of a respective draw arm of a correcting element of the control mechanism.

BRIEF DESCRIPTION OF THE DRAWINGS

One exemplary embodiment of the invention is illustrated in the drawings as part of a shed-forming machine of the Hattersley system for weaving machines.

In the drawings.

DETAILED DESCRIPTION

Figures 1, 2, 3:
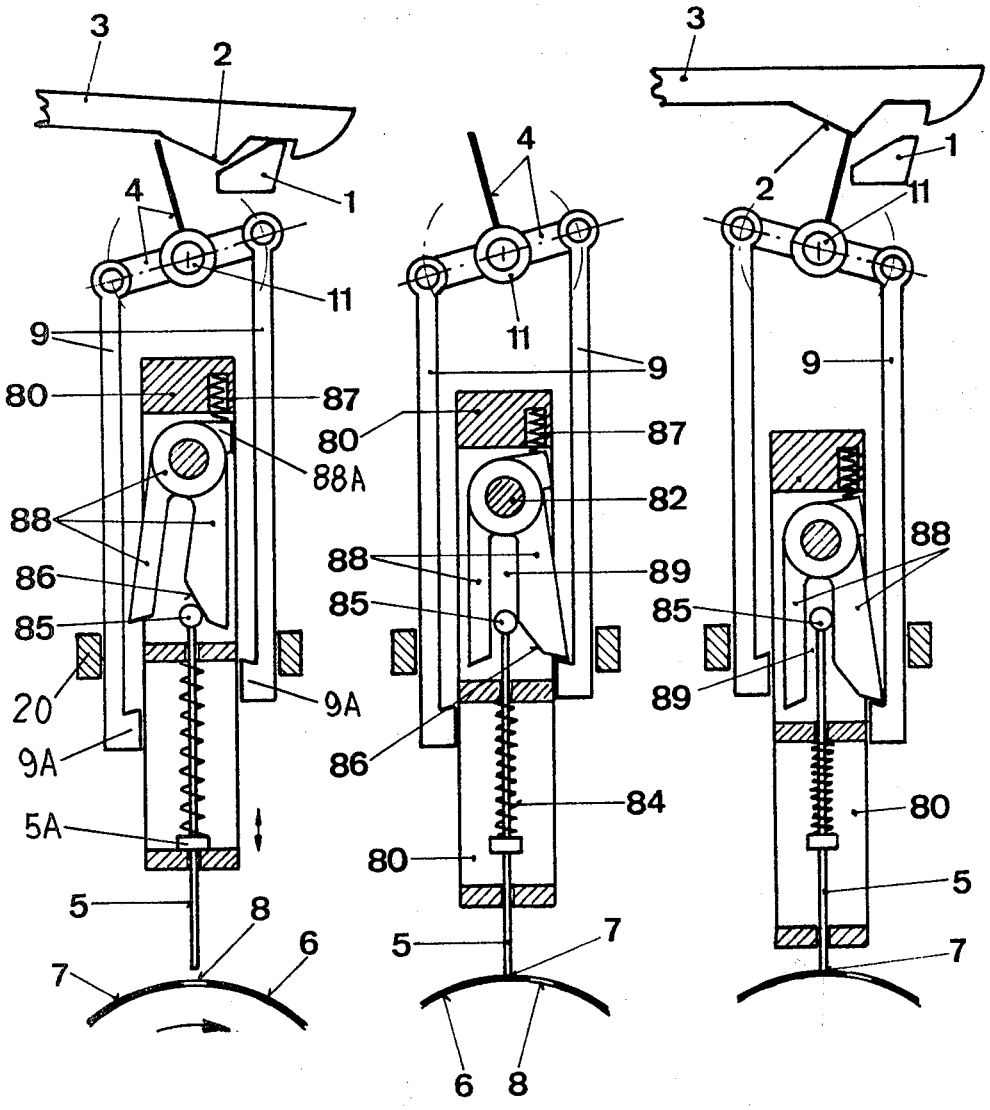
FIG. 1 is a partly schematic, fragmentary sectional view of part of a shed-forming machine having the inventive control device therein and illustrating the initial position in which the force amplifying bar is lifted up.
FIG. 2 is a fragmentary sectional view corresponding to FIG. 1 and illustrates the position of the control device as it starts to read a nonperforated point of the pattern card.
FIG. 3 is a fragmentary sectional view corresponding to FIG. 1 and illustrates the position of the control device after the force amplifying bar has been lowered and the nonperforated point has been read.

The preferred embodiment is described in connection with a machine of the Hattersley system, but could also be installed in other known machines. The control device described is similar in certain respects to that disclosed in my U.S. Pat. No. 4,154,268 which issued on Jan. 26, 1977 and is incorporated herein by reference. Certain known elements which are described briefly here are described in greater detail in my U.S. Pat. No. 4,154,268.

The control device is controlled by a conventional pattern card 6 which has nonperforated areas 7 and perforated areas 8, is repeatedly indexed in the direction of the arrow in FIG. 1, and facilitates a patternlike lifting of a draw hook 3 from a draw knife 1.

A lock member 88 in the form of a two-arm lever is pivotally supported by a shaft 82 on a vertically reciprocal, beamlike force amplifying bar 80. A lock member 88 is provided for each draw hook 3 which must be controlled or for each reading needle 5 which is supported slidingly in openings in the force amplifying bar 80.

The two arms of the lock member 88 extend approximately parallel to one another and form a downwardly opening slot 89 within which is received a head 85 provided at the upper end of the reading needle 5. One arm of the lock has an inclined area 86 on its surface which faces the slot 89 near the lower end of the slot. The two arms of the lock member 88 are arranged and are dimensioned so that, at the end of a swivelling movement, one or the other of the arms will always be projecting laterally beyond the force amplifying bar 80, which arm reaches within the effective range of an offset portion 9A of a respective one of two draw arms 9. The arms 9 are each pivotally connected to different arms of a three-arm correcting element 4. The correcting element 4 is pivotally supported on a stationary shaft 11. The one of the three arms of the element 4 which does not support a draw arm 9 extends upwardly toward a cam surface 2 on the draw hook 3. When the correcting element 4 is rotated in a clockwise direction, the upright arm engages the cam surface 2 and lifts the draw hook 3 upwardly out of engagement with the draw knife 1. As the element 4 rotates, the draw arms 9 reciprocate vertically and are guided by stationary guides 20.

A return spring 84 for the reading needle 5 is supported on a wall of the force amplifying bar 80 and applies pressure to a flange 5A on the reading needle 5. A compression spring 87 is arranged between a recess on the force amplifying bar 80 and a projection 88A on the lock member 88. The spring 87 pivotally urges the lock member 88 in a clockwise direction. Downward movement of the reading needle 5 under the urging of the return spring 84 is limited by engagement of the flange 5A with a wall of the force amplifying bar 80, as shown in FIG. 1.

OPERATION

In the initial position of the control device (FIG. 1), which position is independent of the position of the drawing arms 9, the force amplifying bar 80 is in its highest position. Under the urging of the spring 87, the lock member 88 is urged in a clockwise direction until the sloped surface 86 on the right arm of the lock member 88 rests against the head 85 of the reading needle 5. The end of the left arm of the locking member 88 then projects leftwardly beyond the force amplifying bar 80. As the force amplifying bar 80 is lowered, the lock member 88 initially remains, under the urging of the spring 87 and with respect to the force amplifying bar 80, in the position illustrated in FIG. 1. If the reading needle 5 is lowered into a hole 8 in the pattern card, no change is effected in the position of the lock member 88. The left draw arm 9 remains in the illustrated low position or is pushed into such position by engagement of the left arm of the lock member 88 with the offset portion 9A. If the control device several times in succession reads perforated points 8, no change in the position of the correcting element 4 takes place and the upright third arm of the element 4 does not lift the draw hook 3 using the cam surface 2. The draw hook 3 remains in engagement with the draw knife 1.

If, however, as is illustrated in FIG. 2, the reading needle 5 contacts a nonperforated point 7, then the reading needle 5 is lifted up in the force amplifying bar 80. The head 85 slides on the sloped surface 86 and causes the lock member 88 to pivot in a counterclockwise direction against the urging of the spring 87 into the position shown in FIG. 2. The end of the right arm of the lock member 88 is then in front of and adjacent the offset portion 9A of the right draw arm 9. During a further lowering of the force amplifying bar 80, the head 85 slides upwardly in the slot 89 and holds the lock member 88 in the same position, while the force amplifying bar 80 through the right arm of the lock member 88 pushes the offset portion 9A and draw arm 9 downwardly so that the correcting element 4 pivots about the shaft 11 until the upright third arm of the correcting element 4 engages the cam surface 2 of the draw hook 3 and lifts the draw hook 3 into the raised position shown in FIG. 3. The draw hook 3 is then out of engagement with the draw knife 1.

If the reading needle 5 several times in succession reads nonperforated points 7, the position of the correcting element 4 remains unchanged, even though the lock member 88 under the urging of the spring 87 is temporarily swung back into the position according to FIG. 1 each time the force amplifying bar 80 is raised. Instead of the spring 87, the slot 89 could be constructed over its entire length, including the sloped surface 86, with parallel side surfaces so that a return of the lock member 88 occurs through the urging of the return spring 84 on the reading needle 5 and the retreat of the head 85 into the slot 89.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a reading and control device for a control machine which is controlled by a pattern card having nonperforated points and holes, has a reading needle for reading the pattern card, and has a force amplifying bar movable in the direction of movement of the reading needle relative to a control part, the reading needle being movably supported in the force amplifying bar to project against the pattern card and being in active engagement with a lock member which is pivotally supported on the force amplifying bar for movement between two positions, a portion of the lock member in each such position being in the path of movement of control parts of the control device, the improvement comprising wherein the lock member is a lever having two arms which extend almost parallel to one another to form together a slot in which the head of the reading needle engages; wherein the inner surface of one arm is inclined near its free end and forms a sliding surface for the head of the reading needle; wherein between the lock member and force amplifying bar there is arranged a spring, which facilitates an urging of the inclined sliding surface of the one arm against the head of the reading needle; and wherein the two ends of the lock member during their outermost swings each reach beyond the force amplifying bar and into the path of movement of an offset portion of a respective draw arm for a correcting element of the control mechanism.

2. The device according to claim 1, wherein said control device is adapted for use in a shed-forming machine of the Hattersley system having draw hooks and draw knives, and wherein the correcting element is a three-arm rocking lever, one arm of which lifts the draw hook off the draw knife.

3. The device according to claim 1, wherein engagement of said reading needle with a said nonperforated point of said pattern card in response to movement of said force amplifying bar toward said pattern card effects sliding movement of said reading needle relative to said force amplifying bar, said head of said reading needle sliding into said slot along said inclined surface and effecting pivotal movement of said lock member from one of said two positions to the other of said two positions against the force of said spring.

4. The device according to claim 1, wherein said spring is a helical compression spring having one end supported in a recess in said force amplifying bar and the other end supported on a projection on said lock member, and wherein said spring pivotally urges said lock member toward one of said two positions.

* * * * *